US007001004B2

(12) United States Patent
Bartloff et al.

(10) Patent No.: US 7,001,004 B2
(45) Date of Patent: Feb. 21, 2006

(54) REMOVABLE DISHRACK TRACK STOP

(75) Inventors: William F. Bartloff, Berrien Springs, MI (US); Michael L. Beidler, St. Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 181 days.

(21) Appl. No.: 10/246,144

(22) Filed: Sep. 18, 2002

(65) Prior Publication Data

US 2004/0051428 A1 Mar. 18, 2004

(51) Int. Cl.
*A47B 88/04* (2006.01)

(52) U.S. Cl. ..... 312/334.45; 312/228.1

(58) Field of Classification Search ..... 312/330.1, 312/333, 311, 228.1, 334.45, 334.44, 334.46, 312/334.47; 16/95 R; 384/21
See application file for complete search history.

(56) References Cited

U.S. PATENT DOCUMENTS

| | | | | |
|---|---|---|---|---|
| 3,347,613 A | | 10/1967 | Krzewina et al. | 312/333 |
| 3,982,802 A | | 9/1976 | Bailey | 312/348 |
| 4,097,098 A | | 6/1978 | Fields | 312/311 |
| 4,437,715 A | | 3/1984 | Jenkins | 312/348 |
| 4,535,524 A | | 8/1985 | Jenkins | 312/330 |
| 4,605,265 A | * | 8/1986 | Bessinger et al. | 384/20 |
| 4,934,023 A | | 6/1990 | Schrubring | 16/95 |
| 5,061,020 A | | 10/1991 | Ulrich | 312/228 |
| 5,181,782 A | | 1/1993 | Wojcik | 384/21 |
| 5,242,222 A | | 9/1993 | Michael | 312/334.45 |
| 5,255,983 A | | 10/1993 | Parvin | 384/21 |
| 5,671,986 A | * | 9/1997 | Vinet | 312/334.8 |
| 6,126,255 A | | 10/2000 | Yang | 312/334.46 |

FOREIGN PATENT DOCUMENTS

| | | | |
|---|---|---|---|
| EP | 848930 | * | 6/1998 |
| JP | 59-108443 | | 7/1984 |

* cited by examiner

*Primary Examiner*—James O. Hansen
(74) *Attorney, Agent, or Firm*—Clifton G. Green; Robert O. Rice; John F. Colligan

(57) ABSTRACT

A removable track stop for a dishwasher track movably carrying a dishrack. The track stop has a hollow sleeve that fits into the end of a generally C-shaped track and has a grip that extends from the sleeve and the end of the track. A movable lock member in the sleeve and grip has a lock button extending beyond the grip for actuation by a user at one end. The lock member has locking arms extending from the other end of the lock member inside the sleeve. The locking arms include locking prongs that project through openings in the hollow sleeve and engage locking slots in the upper and lower legs of the C-shaped track to lock the track stop to the track. Pressing on the lock button causes the locking prongs to be withdrawn from the locking slots in the track allowing the track stop to be removed.

19 Claims, 8 Drawing Sheets

REMOVABLE DISHRACK TRACK STOP

BACKGROUND OF THE INVENTION

FIELD OF THE INVENTION

This invention relates to automatic dishwashers and more specifically to a removable track stop for a track movably carrying a dishrack in the dishwasher tub.

DETAILED DESCRIPTION

Figure 1:
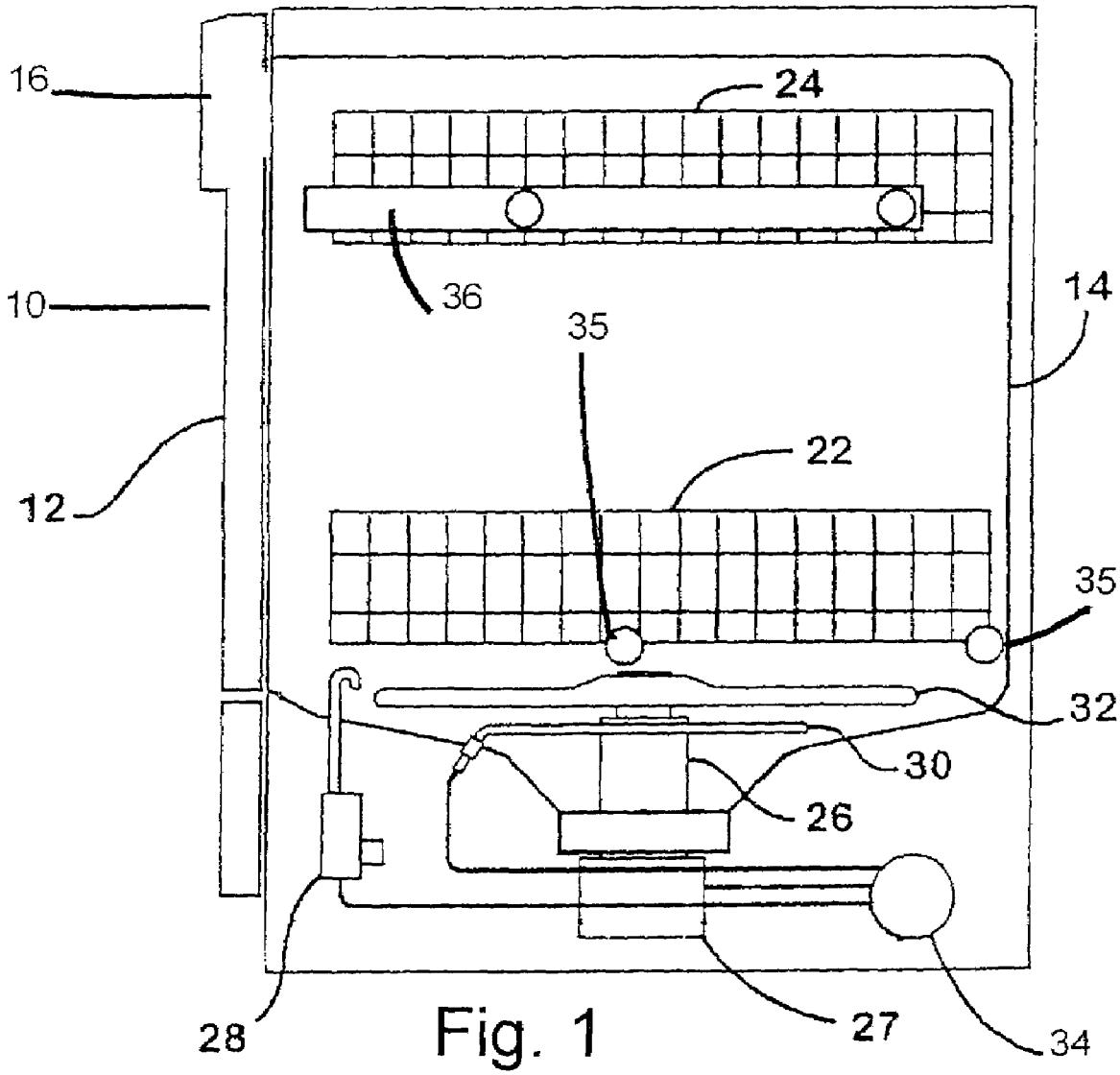
FIG. 1 is a schematic side view of an automatic dishwasher having movably mounted dishracks and illustrating the major components within the dishwasher.

In the exemplary embodiment of the invention as shown in the drawings, a dishwasher generally designated 10 in FIG. 1 includes a door 12 and a tub 14. The door includes a control console 16 provided with input devices such as switches (not shown) to enable a user to select dishwasher cycles and options as is well known to those skilled in the art. The console 16 can also include a display (not shown) to inform the user as to the current status of the dishwasher. Located in the tub 14 are dishracks 22 and 24 upon which dishware items are placed. Supported in the bottom of the tub 14 are a pump 26 and a pump motor 27. Fill valve 28 provides a water inlet to the dishwasher. A heater 30 is supported within the lower portion of the tub 14 for heating wash or rinse liquid. The pump motor 27, fill valve 28, heater 30 and other electrical components can be energized by a power controller 34 as is well known to those skilled in the art. While power controller 34 is shown below tub 14, those skilled in the art will recognize that the power controller 34 can be located elsewhere in the dishwasher such as in the console 16. A spray arm 32 is provided to spray wash and rinse liquid on the dishware during the dishwasher cycles. Although a single spray arm is shown, two or three spray arms can be provided as is well known to those skilled in the art. Upper rack 24 is removably mounted to track assembly 36 to movably support the upper rack in the tub 14. The lower rack 22 can be provided with wheels 35 that can ride on a track formed in the tub 14. Alternately, the lower rack can be provided with a track similar to track assembly 36.

Referring now to FIG. 2, FIG. 3, FIG. 4 and FIG. 5, an exemplary track assembly 36 that can be used with the invention is shown. Track assembly 36 includes an outer track 37 and an inner track 38. While one track assembly is shown in FIG. 2–FIG. 5, is should be understood that a similar track can be provided for the other side of dishrack 24. Outer track 37 and inner track 38 can be generally C-shaped channels. The outer track and inner track can be formed of stainless steel. Other materials can be used to form the outer and inner track as is well known to those skilled in the art. Inner track 38 can be slidably supported in outer track 37 by balls (not shown) held in place by a cage 39 positioned between the inner and outer tracks. The top leg 41 and bottom leg 42 of the C-shaped inner track 38 can have a concave outer surface to form part of the race for the balls. The top leg 43 and bottom leg 44 of the outer track 37 can have a convex inner surface to form an opposing portion of the race for the balls. A cage 39 can be positioned in the space between top legs 41 and 43 and bottom legs 42 and 44 and trap two balls longitudinally between top legs 41 and 43 and two balls longitudinally between bottom legs 42 and 44. Cage 39 can be molded polypropylene. Thus, inner track 38 can be slidably mounted within outer track 37.

Each outer track 37 can be mounted to the tub 14 by a pair of C-shaped track mounts 45 that hold the top leg 43 and bottom leg 44 of the outer track 37. Track mounts 45 can be held to the tub wall by screws or other suitable fasteners (not shown). The outer track 37 can snap into the track mounts 45. Outer track 37 can be held against longitudinal motion relative to the track mounts 45 by projections (not shown) formed in the surface of the outer track that engage each track mount 45. Track mounts 45 can be injection molded of a plastic material such as polyoxymethylene.

[0014] The upper rack 24 can have a pair of wheels 46 that are sized to ride in the inner track 38. The peripheral surface 47 of the wheels 46 can be concave to fit the convex inner surface of the upper leg 41 and lower leg 42 of the inner track 38. Wheels 46 can be rotatably mounted to brackets 48 carried on the sides of upper rack 24. A track stop 50 is provided to close the outward end of track assembly 36 and thereby engage the forward wheel 46 to prevent the dishrack 24 from being fully withdrawn from the track assembly 36 when the track stop 50 is installed in the track assembly 36. When forward wheel 46 engages the track stop 50 further outward movement of the dishrack by the user causes the inner track 38 to move longitudinally outward in outer track 37. Movement of inner track 38 can be limited by a suitable stop formed in outer track 37. A stop (not shown) can be formed in outer track 37 in the form of tabs in top leg 43 and bottom leg 44 that engage the rear ball (not shown) as inner track 38 and cage 39 are withdrawn relative to outer track 37. The stop (not shown) formed in outer track 37 can also provide a stop to prevent cage 39 from moving too far in as dishrack 24 and inner track 38 are returned into the tub 14 by engaging the front ball (not shown) as inner track 38 moves inwardly relative to outer track 37. Those skilled in the art will understand that other stop arrangements to limit the motion of inner track 38 relative to outer track 37 can be used.

In order to provide the user with flexibility in using the dishwasher it would be advantageous to be able to remove the upper dishrack 24 in order to wash large items in the dishwasher. Prior art track stops are not easily removed by the user to allow the upper dishrack to be readily removed from the dishwasher.

Figure 2:
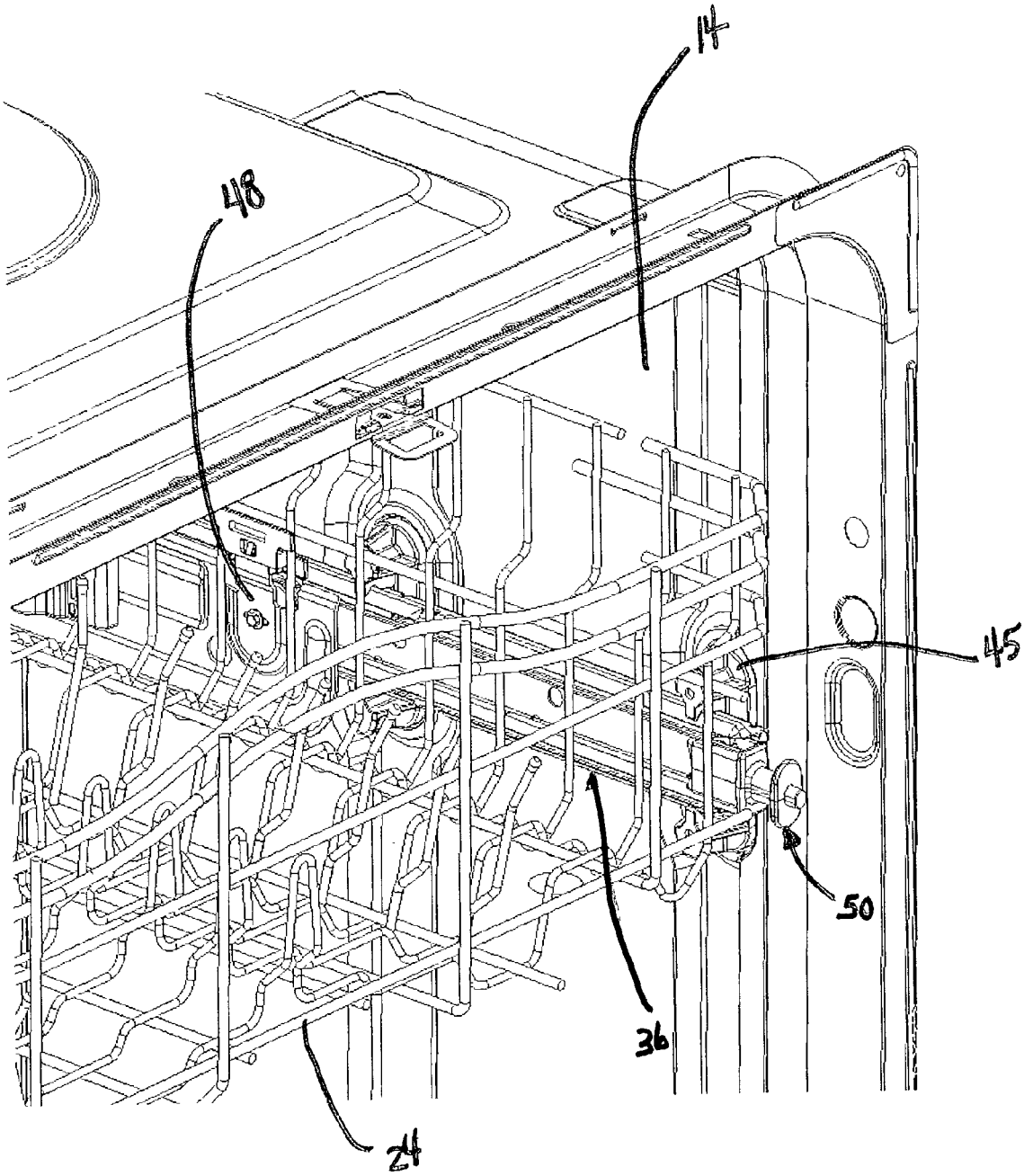
FIG. 2 is a partial perspective view of an automatic dishwasher having a track stop according to the invention.
Figure 3:
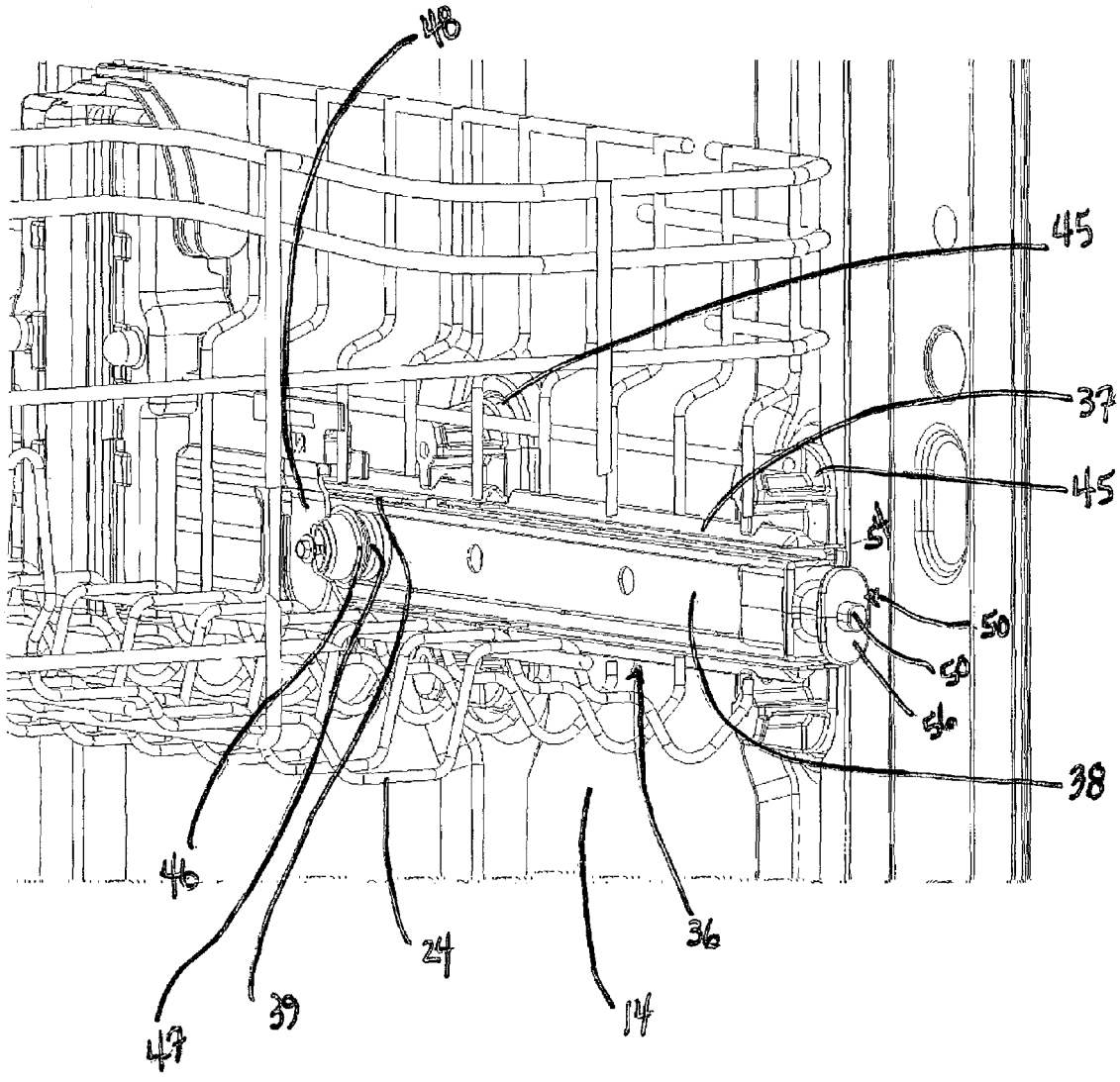
FIG. 3 is a partial perspective view with portions of the dishrack cutaway to show the dishrack wheel in the track and the track stop.
Figure 4:
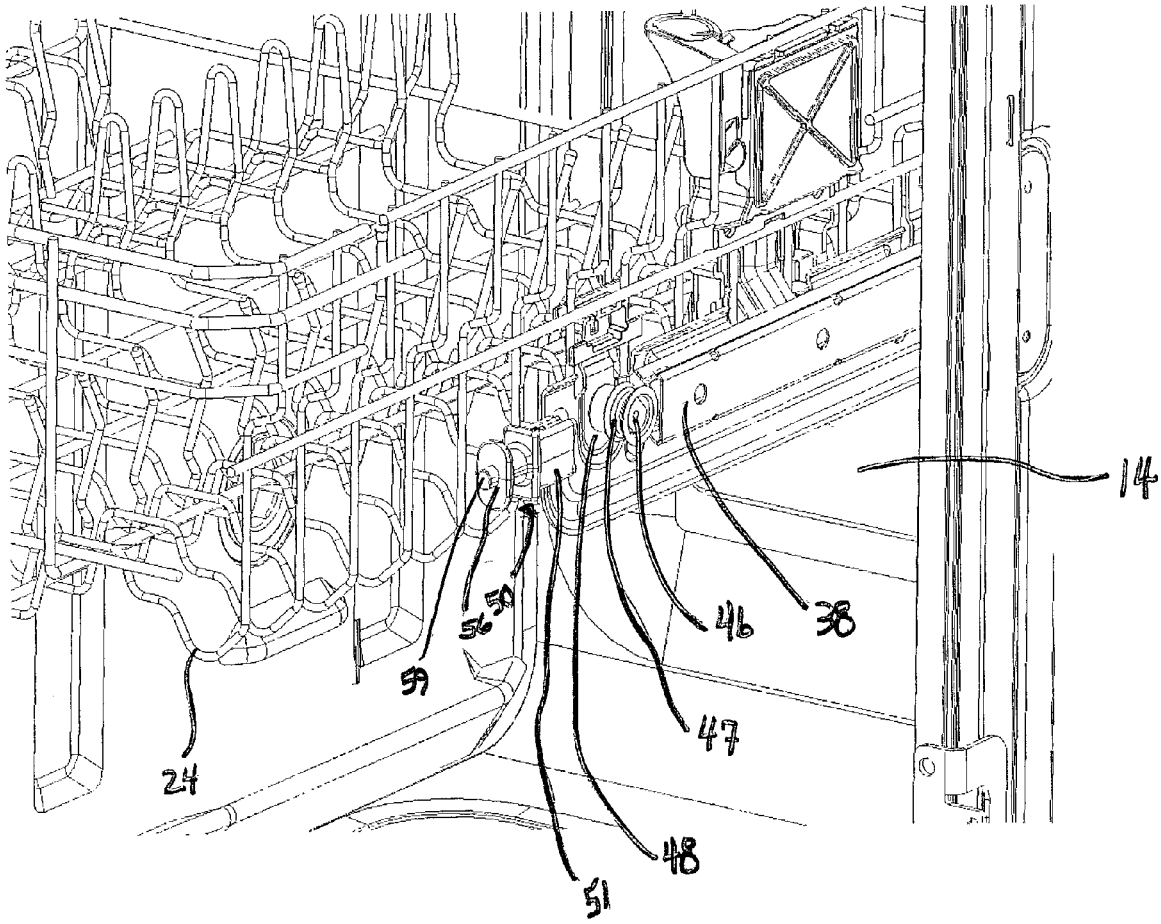
FIG. 4 is a partial perspective view showing the track stop removed from the track and the dishrack partially withdrawn from the track.
Figure 5:
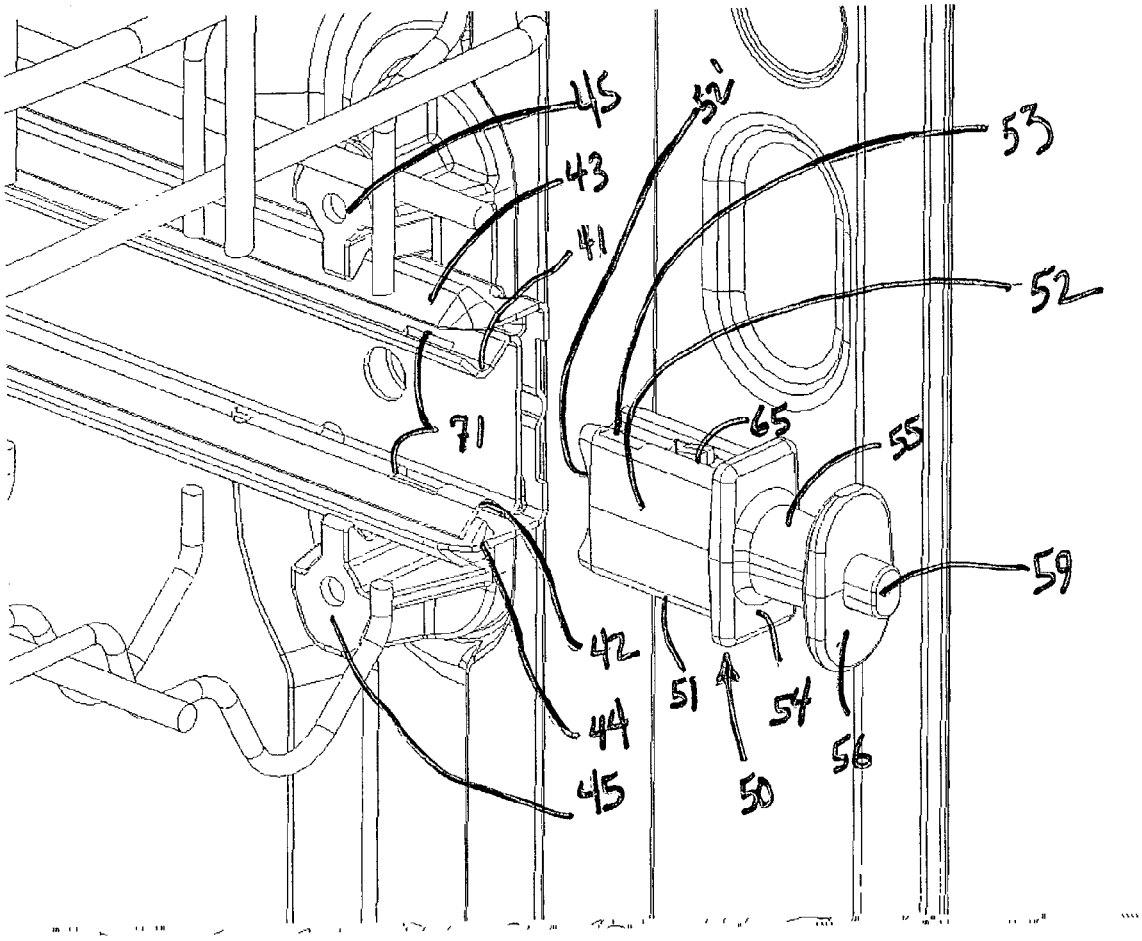
FIG. 5 is a partial perspective view showing the track stop removed from the track.

Referring to FIG. 2–FIG. 4 and particularly to FIG. 5, a removable track stop 50 according to the invention is shown. Track stop 50 includes a hollow sleeve portion 51 sized to be received in the end of inner track 38. Sleeve portion 51 includes a pair of side walls 52 and top and bottom surfaces 53. In the described embodiment top and bottom surfaces 53 are concave to correspond to the convex inner surfaces of inner track top and bottom legs 41 and 42. Those skilled in the art will understand that top and bottom surfaces 53 can assume different shapes for use with tracks having a different configuration. Thus, sleeve portion 51 slidably fits in the open end of inner track 38. In FIG. 4, track stop 50 is removed from the track assembly 36 and upper rack 24 is partially withdrawn to the extent that wheel 46 is withdrawn from inner track 38.

Figure 7:
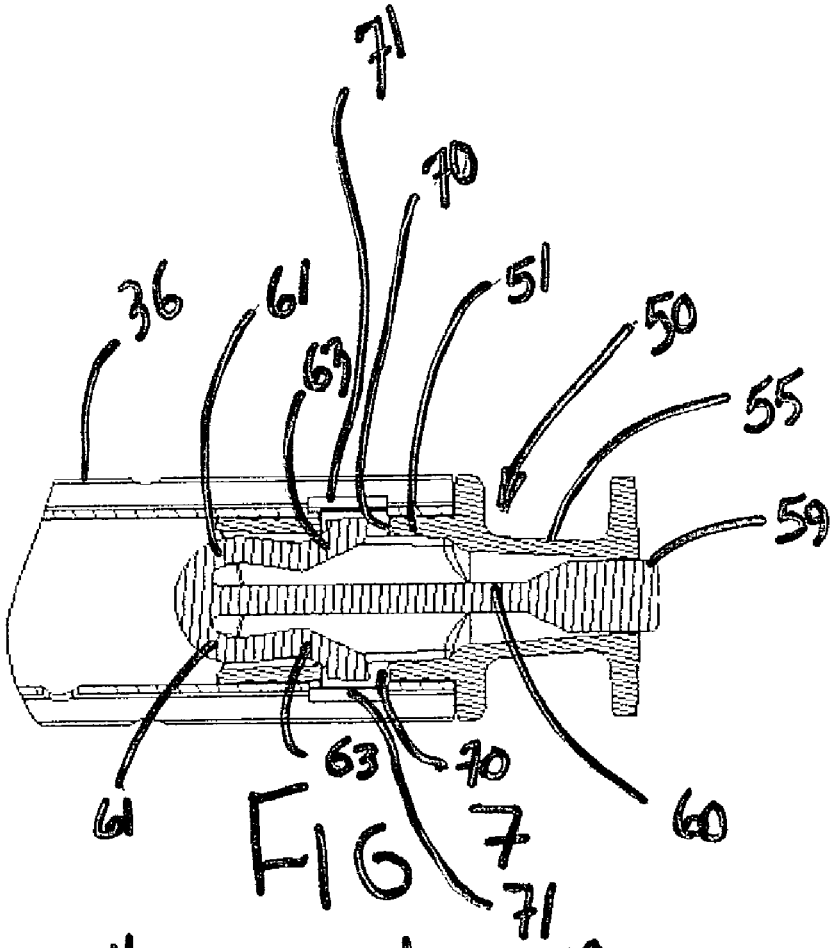
FIG. 7 is a partial sectional view showing the track stop ready for removal from the track.
Figure 6:
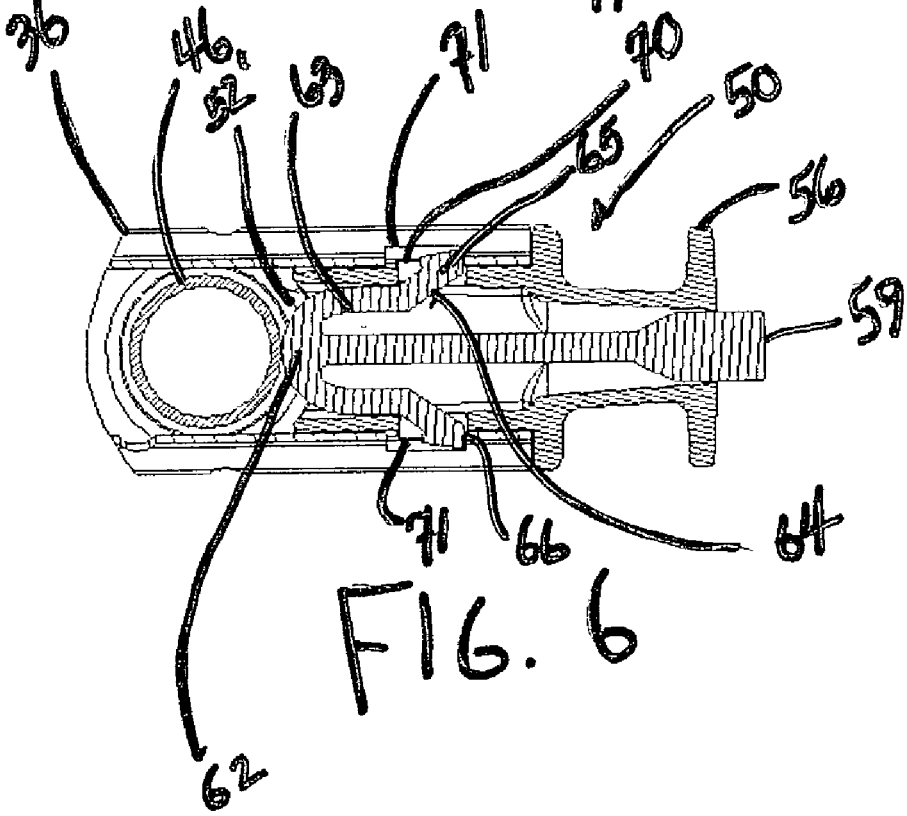
FIG. 6 is a partial sectional view showing the track stop installed on the track and the dishrack wheel in contact with the track stop.
Figure 8:
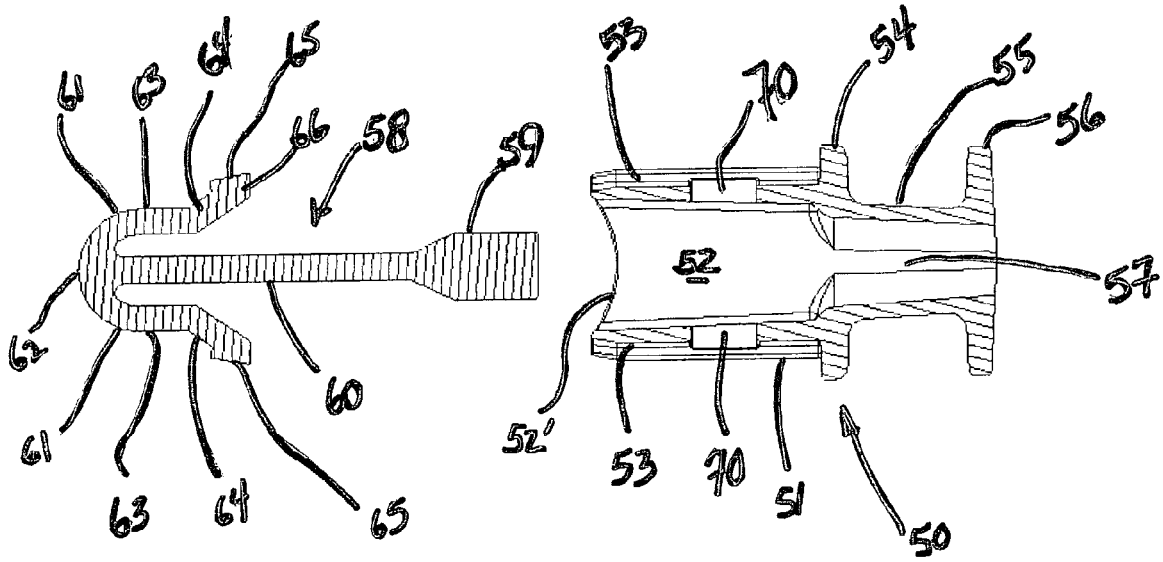
FIG. 8 is an exploded sectional view of the track stop.

Turning to FIG. 6–FIG. 8, track stop 50 can include a sleeve flange 54 at one end of sleeve portion 51. Sleeve flange 54 functions to limit insertion of track stop 50 into the inner track 38 and to prevent a user's hand from contacting the end of inner track 38 when removing or reinstalling track stop 50. Track stop 50 also includes a grip portion 55 extending from sleeve portion 51 and sleeve flange 54 and can be terminated by a grip flange 56. Grip portion 55 has a lock button opening 57 through the center of grip portion 55 and coaxial with the center of hollow sleeve portion 51.

Track stop 50 also includes a lock 58 that is positioned in hollow sleeve portion 51 and the opening 57 in grip portion 55. At one end of lock 58 a lock button 59 forms an extension of shaft 60. At the opposite end of shaft 60 are a pair of curvilinear locking arms 61. Locking arms 61 extend away from nose 62 toward lock button 59 and are spaced from shaft 60. Locking arms 61 include a slide surface 63 generally parallel to shaft 60 and a ramp surface 64 extending outwardly from slide surface 63 opposite nose 62. Ramp surfaces 64 end in locking prongs 65 at the ends of locking arms 61. Sleeve portion 51 has a pair of sleeve lock openings 70 in top and bottom surfaces 53 sized to receive locking prongs 65 and the ramp surfaces 64. The inner track 38 top leg 41 and bottom leg 42 each have a track lock opening 71 which are aligned with sleeve lock openings 70 when track stop 50 is positioned in inner track 38. While two locking arms 61 are shown in the described embodiment, one locking arm could be employed within the scope of the invention.

Referring to FIG. 6 and FIG. 7, the operation of the track stop 50 and lock 58 can be seen. In FIG. 6 track stop 50 is positioned in track assembly 36 and forward dishrack wheel 46 is engaging the nose 62 of track stop 50. Slide surfaces 63 of lock 58 are engaging the inner surfaces of sleeve top and bottom surfaces 53. Ramp surfaces 64 and locking prongs 65 are positioned in sleeve lock openings 70. Locking prongs 65 extend into track lock openings 71 to prevent track stop 50 from being removed from the end of inner track 38. The distal ends 66 of locking prongs 65 engage the sleeve lock openings 70 and track lock openings 71 to prevent track stop 50, and accordingly dishrack wheel 46 from being further withdrawn from the tub 14. As further shown in FIG. 6, lock button 59 extends beyond grip flange 56. Locking arms 61 are resilient and bias locking prongs 65 into sleeve lock openings 70 and track lock openings 71.

Turning to FIG. 7, track stop 50 is shown in the end of track assembly 36 with lock button 59 depressed against the spring force of locking arms 61. Movement of lock button 59 inwardly relative to sleeve portion 51 moves shaft 60 and locking arms 61 relative to sleeve portion 51. Movement of locking arms 61 relative to sleeve portion 51 causes ramp surfaces 64 to engage sleeve lock openings 70 and deflect locking arms 61 inwardly toward shaft 60. The deflection of locking arms 61 is sufficient to withdraw locking prongs 65 from track lock openings 71 and thereby allow track stop 50 to be removed from the end of track assembly 36. Locking prongs 65 continue to engage sleeve lock openings 70 to prevent lock 58 from being easily removed from sleeve 51. To assemble lock 58 in sleeve portion 51, locking arms 61 are deflected inwardly to allow insertion of lock 58 into the open end of sleeve portion 51.

Figure 9:
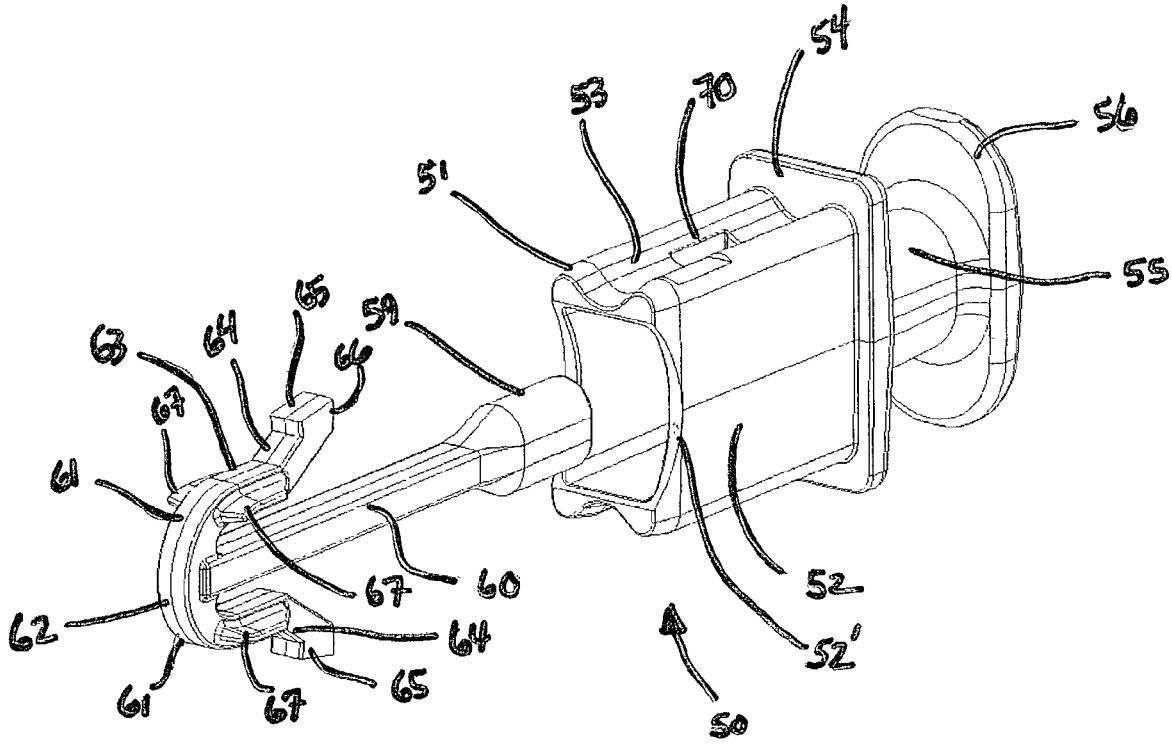
FIG. 9 is an exploded perspective view of the track stop.

Turning to FIG. 9 lock 58 is shown unassembled in the sleeve portion 51 and grip portion 55. Locking arms 61 can have positioning ribs 67 on the sides of the locking arms 61 to help position the lock 58 in the hollow sleeve portion 51 with ramp surfaces 64 and locking prongs 65 aligned with sleeve lock openings 70. Lock button 59 formed at the end of shaft 60 can be oval in configuration to assist in positioning lock 58 in sleeve portion 51 with ramp surfaces 64 and locking prongs 65 positioned in sleeve lock openings 70. Lock button opening 57 in grip portion 55, see FIG. 5, can also be oval in configuration to slidably support lock button 59.

Turning FIG. 6 and FIG. 9, sleeve portion side walls 52 can be inwardly curved at their inward end 52' to allow wheel 46 to contact nose 62 rather than sleeve portion 51 when dishrack 24 is withdrawn into contact with track stop 50. Thus, the force of dishrack 24 being withdrawn against the track stop 50 can be transmitted directly through lock 58 through locking arms 61 and locking prongs 65 to the inner track slots 71 and thereby to the inner track 38.

Sleeve portion 51 and grip portion 55 can be injection molded of polypropylene that is 20% talc filled. Sleeve portion 51 and grip portion 55 can be molded in one piece, or as is well known to those skilled in the art molded in two pieces and subsequently assembled. Lock 58 can be injection molded of polyoxymethylene. Those skilled in the art will recognize that other materials can be used to form sleeve portion 51 and grip portion 55 and also to form lock 58.

In operation track stops 50 can positioned in the ends of track assemblies 36 on each side of dishrack 24. Locking prongs 65 lock track stop 50 into the end of inner track 38 as locking prongs 65 extend into track lock openings 71 through sleeve lock openings 70. Dishrack 24 can be withdrawn from tub 14 until forward wheels 46 engage noses 62 on track stops 50. As described above, lock 58 transmits force from dishrack wheel 46 to inner track 38. Continued movement of dishrack 24 outwardly will cause inner track 38 to slide longitudinally in outer track 37 on balls (not shown) held in place by cage 39. When dishrack 24 has been substantially fully withdrawn from tub 14, stops formed in outer track 37 stop further longitudinal movement of inner track 38 relative to outer track 37 as described above in paragraph [0014].

In order to remove a track stop 50, the user can place an index finger and middle finger between sleeve flange 54 and grip flange 56 to grip the gripping portion 55 and press lock button 59 with the thumb. As mentioned above, pressing lock button 59 withdraws locking prongs 65 from track lock openings 71 in the inner track top leg 41 and bottom leg 42 and thereby allow the track stop 50 to be withdrawn from inner track 38. A track stop 50 can be reassembled to the end of a track assembly 36 by gripping the gripping portion 55 between the between sleeve flange 54 and grip flange 56 with the index and middle fingers and depressing lock button 59 with the thumb. With the lock button 59 depressed the track stop 50 can be inserted into the open end of inner track 38 until sleeve flange 54 engages the end of the inner track 38. Lock button 59 can then be released allowing the ramp surfaces 64 to urge lock 58 toward the grip portion 55 of track stop 50. Movement of lock 58 longitudinally toward grip portion 55 will allow the ramp surfaces 64 to move outwardly against the inner surface of sleeve top and bottom surfaces 53 and sleeve lock openings 70 until the lock 58 moves locking prongs 65 into registration with track lock openings 71. When locking member 58 moves to the position shown in FIG. 6, the resilience of locking arms 61 will cause the locking arms 61 move outwardly so that locking prongs 65 reenter track lock openings 71. Locking arms 61 are resilient and provide sufficient spring force to drive lock 58 toward the grip portion 55 when lock button 59 is not being pressed by the user.

Once track stops 50 are removed form the ends of the track assemblies, the upper dishrack 24 can readily be withdrawn from the tub. Once upper dishrack 24 is withdrawn from tub 14 track stops 50 can be reinstalled in track assemblies 36 and the track assemblies returned into the tub 14.

In order to reinstall the upper dishrack 24 the process is reversed. The track stops 50 are removed from the end of track assemblies 36. The upper dishrack 24 can be installed by inserting wheels 46 into the open end of inner track 38 and sliding the dishrack 24 into the tub 14. When upper dishrack 24 is fully inserted, track stops 50 can be reinstalled in the ends of track assemblies 36 as described above.

While the invention has been specifically described in connection with certain specific embodiments thereof, it is to be understood that this is by way of illustration and not of limitation, and the scope of the appended claims should be construed as broadly as the prior art will permit.

We claim:

1. A removable track stop for a dishwasher having a track for movably carrying a dishrack for holding items to be washed comprising:

a hollow sleeve portion received in an end of said track;

a grip portion extending from said sleeve portion; and a lock member axially movably carried in said sleeve portion and said grip portion and having a lock button extending beyond said grip portion for actuation by a user, said lock member arranged such that when said lock member is in a first position in said sleeve portion said lock member prevents said sleeve portion from moving relative to said track, and when said lock member is manually moved to a second position in said sleeve portion said sleeve portion can be withdrawn from said track thereby allowing said dishrack to be removed from said dishwasher;

wherein said lock member is manually moved to said second position in said sleeve by pressing said lock button.

2. The removable track stop of claim 1 wherein said lock button extends through said grip portion.

3. The removable track stop of claim 1 wherein said lock member comprises a shaft having said lock button formed on one end and a pair of resilient curved locking arms extending from the opposite end of said shaft along and spaced outwardly relative to said shaft.

4. The removable track stop of claim 3 wherein said track is C-shaped with top and bottom legs and said sleeve portion has top and bottom walls that engage said top and bottom legs of said track, and wherein the distal ends of said locking arms extend outwardly relative to said shaft and form locking prongs that extend through lock openings in said top and bottom walls of said sleeve and engage slots formed in said top and bottom legs of said track to lock said sleeve in said track when said lock member is in said first position.

5. The removable track stop of claim 4 wherein said locking arms have a ramp surface adjacent said lock prongs and said lock openings in said sleeve portion are sized to accommodate said ramp surfaces and said locking prongs when said lock member is in said first position, and when said locking member is in said second position said ramp surfaces engage said lock openings and deflect said locking arms inwardly whereby said locking prongs are withdrawn from said slots in said top and bottom legs of said track.

6. A removable track stop for a generally C-shaped elongated track having a vertical portion, a top leg extending from the upper end of the vertical portion, a bottom leg extending from the lower end of the vertical portion, a first end, and at least one of said top and bottom legs having a track slot adjacent said first end comprising:

a hollow sleeve portion arranged to be inserted into said first end of said track and having a lock opening in at least one of the surfaces arranged to engage said top and bottom legs and positioned to be aligned with said at least one track slot when said sleeve portion is inserted into said first end of said track;

a grip portion extending portion extending outwardly from said track when said sleeve portion is inserted into said first end of said track, said grip portion having a hole extending from said hollow sleeve portion to the outward end of the grip portion; and a lock member having a first end having at least one locking arm attached to a first end of a shaft and arranged to fit within said hollow sleeve portion, said shaft having a second end arranged to slidably fit within said hole in said grip portion and having a distal end that extends beyond the outward end of said grip portion when said lock is positioned in said sleeve portion, said at least one locking arm having a ramp surface and a distal locking prong arranged to extend through said lock opening in said sleeve portion and into said at least one track slot when said sleeve portion is inserted into said first end of said track to lock said track stop to said track;

wherein depressing the distal end of said shaft relative to said grip portion causes said lock member to move axially relative to said sleeve portion and causes the ramp surface of said locking arm to engage said lock opening in said sleeve portion and withdraw said locking prong from said track slot thereby allowing said track stop to be withdrawn from said track.

7. The removable track stop of claim 6 wherein said lock member has first and second curvilinear locking arms extending from opposite sides of said shaft and each of said locking arms have a ramp surface and a locking prong at the distal end of the locking arm, and wherein said sleeve portion has lock openings in the surfaces facing said top and bottom legs.

8. The removable track stop of claim 7 wherein said lock member has positioning ribs on opposite sides of each of said locking arms to position said lock member in said hollow sleeve portion with said ramp surfaces and locking prongs aligned with said sleeve portion lock openings.

9. The removable track stop of claim 6 wherein said hollow sleeve portion is substantially rectangular and said lock openings are on the top and bottom surfaces of said sleeve portion.

10. The removable track stop of claim 9 wherein said sleeve portion has a sleeve flange extending outwardly from said sleeve portion at the junction with said grip portion to limit travel of said sleeve portion into said first end of said track.

11. The removable track stop of claim 10 wherein said grip portion has a grip flange at the outward end of said grip portion, and said sleeve flange and grip flange form a finger grip between said sleeve flange and said grip flange.

12. The removable track stop of claim 11 wherein said hole in said grip portion extends through said grip flange, and wherein the distal end of said shaft projects through said hole in said grip portion and forms a lock button for depressing said lock member to allow said track stop to be removed from said track.

13. The removable track stop of claim 12 wherein said distal end of said shaft is oval-shaped and said hole in said grip portion is oval-shaped.

14. A dishwasher having a tub with sidewalls; a generally C-shaped elongated track movably mounted to a sidewall and having a vertical portion and top and bottom legs extending from the upper and lower ends of the vertical portion, a first end, and having a slot adjacent said first end in each said top and bottom legs; and a removable track stop for said tracks comprising:

a hollow rectangular sleeve portion arranged to be inserted into said first end of said track and having a lock opening in each of the surfaces of said sleeve portion arranged to engage said top and bottom legs, said lock openings being positioned to be aligned with said slots in said top and bottom legs when said sleeve portion is inserted into said first end of said track;

a grip portion extending outwardly from said track when said sleeve portion is inserted into said first end, said grip portion having a hole extending from said hollow sleeve portion to the outward end of the grip portion; and a lock member having a first end having first and second curvilinear locking arms attached to opposite sides of one end of a shaft and arranged to fit within said hollow sleeve portion, said shaft having a second end arranged to slidably fit within said hole in said grip portion and having a distal end that extends beyond the outward end of said grip portion when said lock member is positioned in said sleeve portion, said locking arms having oppositely facing ramp portions and oppositely facing locking prongs at the distal end of said locking arms and arranged to extend through said openings in said sleeve portion and said slots in said top and bottom legs when lock member is positioned in said sleeve portion and said sleeve portion is positioned in said first end of said track thereby locking said track stop in said track;

wherein depressing the distal end of said shaft relative to said grip portion causes said lock member to move axially relative to said sleeve portion and causes the respective ramps on said locking arms to engage the openings in said sleeve portion and withdraw said lock prongs of said locking arms from said slots in said top and bottom legs allowing said track stop to be withdrawn from said track.

15. The dishwasher of claim 14 wherein said hollow sleeve portion is substantially rectangular and said lock openings are on the top and bottom surfaces of said sleeve portion.

16. The dishwasher of claim 15 wherein said sleeve portion has a sleeve flange extending outwardly from said sleeve portion at the junction with said grip portion to limit travel of said sleeve portion into said first end of said track.

17. The dishwasher of claim 16 wherein said grip portion has a grip flange at the outward end of said grip portion, and said sleeve flange and grip flange form a finger grip between said sleeve flange and said grip flange.

18. The dishwasher of claim 17 wherein said hole in said grip portion extends through said grip flange, and wherein the distal end of said shaft projects through said hole in said grip portion and forms a lock button for depressing said lock member to allow said track stop to be removed from said track.

19. The dishwasher of claim 18 wherein said distal end of said shaft is oval-shaped and said hole in said grip portion is oval-shaped.

* * * * *